United States Patent [19]

Pilorget

[11] 3,982,346

[45] Sept. 28, 1976

[54] CARTRIDGE OR CARTRIDGE CASE EJECTORS FOR REVOLVER CYLINDERS

[76] Inventor: Andre Pilorget, 37 Chemin de Bellevue, Chatou (Yvelines), France

[22] Filed: Feb. 27, 1975

[21] Appl. No.: 553,788

[30] Foreign Application Priority Data

Mar. 7, 1974 France ..... 74.07721

[52] U.S. Cl. ..... 42/68

[51] Int. Cl.[2] ..... F41C 15/00

[58] Field of Search ..... 42/68, 62, 59, 89

[56] References Cited

UNITED STATES PATENTS

| | | | |
|---|---|---|---|
| 881,437 | 3/1908 | Neal | 42/89 |
| 1,202,342 | 10/1916 | Wesson | 42/89 |
| 2,624,970 | 1/1953 | Rowe | 42/68 |

*Primary Examiner*—Charles T. Jordan
*Attorney, Agent, or Firm*—Young & Thompson

[57] ABSTRACT

An ejector for ejecting catridge cases from the cylinder of a revolver, comprises a pin for which the center of the revolver cylinder serves as a guide. A star-shaped disc is secured to this pin; and a flexible annular element whose outer edges are smoothed off, projects slightly from the bottom of each of the notches in the star-shaped disc. The annular element is secured to the disc against removal from the disc in a direction lengthwise of the pin; but the annular element can retract into the notches, so that when rimmed cartridges are introduced into the chambers of the revolver cylinder, the annular element retracts into the notches and slides along the cartridges. But when grooved cartridges are introduced into the cylinder chambers, the annular element retracts into the notches as the cartridges pass but projects again and penetrates into the cartridge grooves as soon as the cartridge grooves are situated in front of the annular element.

3 Claims, 4 Drawing Figures

CARTRIDGE OR CARTRIDGE CASE EJECTORS FOR REVOLVER CYLINDERS

Revolver cylinders are provided with a central push-rod ejector permitting the simultaneous ejection from their respective chambers of the cartridges which have been placed therein or the cases of those cartridges which have been fired, this being achieved through the action of a suitably notched disc acting on the rims of the cartridges which project from the cylinder chambers.

In order to enable rimless cartridges (so-called "groove type" cartridges for automatic weapons) to be used with the same ejectors, intermediate parts have been proposed which are known as "clips" and which grip by their grooves one or more neighbouring cartridges which receive the thrust of the ejector and transmit it to the grooves of the neighbouring cartridges gripped by the clips. This solution is not practical because of these intermediate parts, which can easily be lost, and because of the time required for placing them in position and replacing them after firing.

The present invention overcomes these disadvantages by incorporating, in a suitable recess in the notched disc, a flexible annular element whose outer edges are smoothed off and which project slightly from the bottom of each notch in the said ejector. This flexible annular element may be a closed circular ring or else a ring which has a break of continuity, in which case it is provided with a means preventing its rotation so that this break of continuity does not entail the risk of being situated in front of the bottom of one of the notches in the ejector disc.

Thus constituted, the ejector equipped in accordance with the present invention makes it possible to receive in the cylinder chambers: either rimmed cartridges, in which case the flexible ring retracts into its recess and slides along the cartridge; or grooved cartridges introduced one by one, in which case the flexible ring retracts into its recess as the cartridge passes but projects again and penetrates into the groove in the cartridge as soon as the groove is situated in front of it.

The accompanying drawings show by way of example without limitation one embodiment of the invention.

Figure 2:
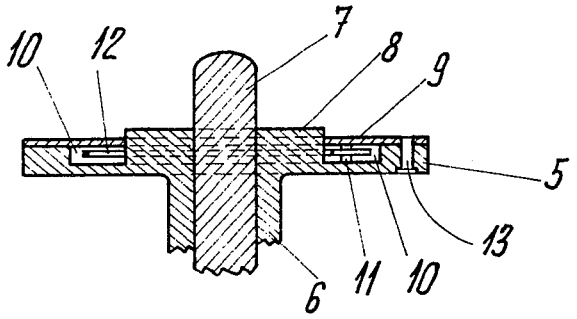
FIG. 2 is a view in section on the line 2—2 in FIG. 1.
Figure 1:
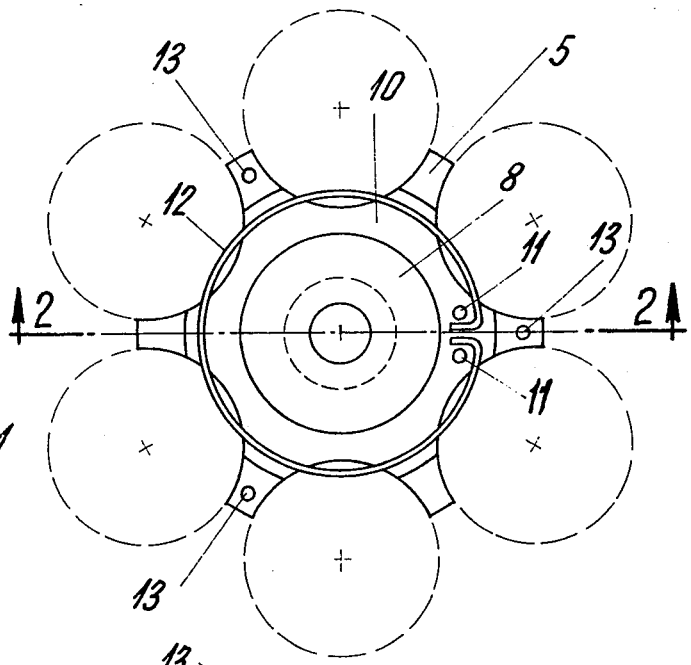
FIG. 1 is a plan view of the notched, recessed disc of the ejector, unclosed.
Figure 4:
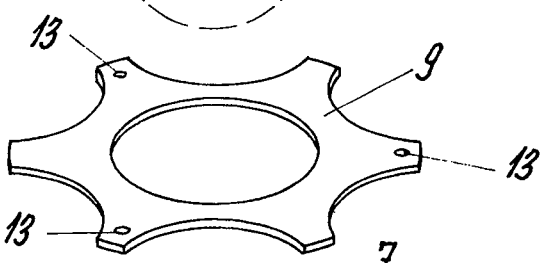
FIG. 4 shows, likewise in perspective, the corresponding notched plate ready to close the notched disc after the flexible ring has been placed in its recess.
Figure 3:
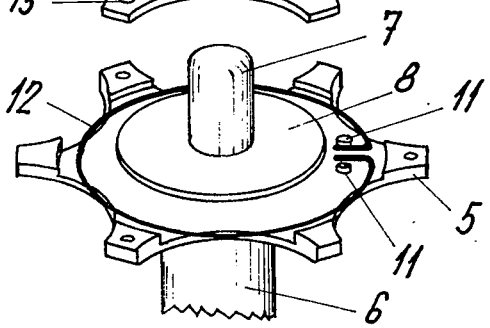
FIG. 3 shows the unclosed notched disc in perspective.

In the drawings the same numbers designate the same elements; 5 is the notched disc of the ejector, 6 is its pin, 7 its push-button of the cylinder pin, 8 its concentric disc effecting the centring of the cover 9 closing the recess 10, the latter carrying two projecting studs 11 intended to prevent the rotation of the flexible ring 12 which is enclosed (with suitable play) in the said recess 10 when the cover 9 is placed in position and joined to disc 5 by three small rivets 13. It can be seen in FIG. 1 that the notches of the disc 5 and of its cover 9 have the same radius as the circles shown in broken lines, which correspond to the cylinder chambers (well known and not shown) of the revolver, the centre of which cylinder serves as a guide for the pin 6 of the ejector.

It can be seen that, being disposed in this manner, the ejector shown provides all the advantages indicated in the preamble, and it will readily be realised that the means indicated may be applied to all cylinders, whatever the number of chambers contained in them.

The embodiment described above and illustrated has obviously been described and illustrated only by way of example and may widely vary without impairing the characteristics of the invention as claimed hereinbelow.

I claim:

1. An ejector for ejecting cartridge cases from the cylinder of a revolver, comprising a pin for which the center of the revolver cylinder serves as a guide, a disc secured to the pin, there being a plurality of outwardly opening notches spaced about the periphery of the disc, a flexible annular element whose outer edges are smoothed off and which projects slightly from the bottom of each notch in said disc, and means securing said annular element to said disc against removal from said disc in a direction lengthwise of said pin but permitting retraction of said annular element into said notches, whereby when rimmed cartridges are introduced into chambers of the revolver cylinder the annular element retracts into said notches and slides along the cartridges, and when grooved cartridges are introduced into the cylinder chambers the annular element retracts into said notches as the cartridges pass but projects again and penetrates into the cartridge grooves as soon as the cartridge grooves are situated in front of the annular element.

2. An ejector as claimed in claim 1, said disc having a recess therein within which said annular element is disposed, said securing means comprising a notched plate that is secured to said disc and closes said recess and retains said annular element in said recess, said notched plate having notches therein that register with the notches in said disc.

3. An ejector as claimed in claim 1, said annular element comprising a discontinuous ring, and means preventing rotation of said ring relative to said disc.

* * * * *